US005561874A

United States Patent [19]

Malofsky et al.

[11] Patent Number: 5,561,874

[45] Date of Patent: *Oct. 8, 1996

[54] CHILD AND INFANT ENCLOSURE STRUCTURE COMPRISED OF TUBING SECTIONS OF LIGHTWEIGHT, HIGH MODULUS, FIBER REINFORCED PLASTIC MATRIX COMPOSITE

[76] Inventors: Adam G. Malofsky, 37 Country Walk, Huntington, Conn. 06484; Bernard M. Malofsky, 1001 Trout Brook Crossing, Rocky Hill, Conn. 06067; Paul R. Glassberg, 13 Chesterwoods Dr., Chester, N.J. 07930

[ * ] Notice: The term of this patent shall not extend beyond the expiration date of Pat. No. 5,533,215.

[21] Appl. No.: 307,924

[22] Filed: Sep. 16, 1994

[51] Int. Cl.[6] ..... A47D 13/06

[52] U.S. Cl. ..... 5/99.1; 5/93.1; 428/36.4; 428/902

[58] Field of Search ..... 5/93.1–99.1, 655; 256/19, 25; 428/902, 36.4

[56] References Cited

U.S. PATENT DOCUMENTS

| | | | |
|---|---|---|---|
| D. 304,523 | 11/1989 | Dillner et al. | 5/99.1 |
| 3,800,341 | 4/1974 | Davanzo | 5/99.1 |
| 3,916,802 | 11/1975 | Virtue et al. | 5/93.1 |
| 4,301,201 | 11/1981 | Stout | 428/36.4 |
| 4,491,992 | 1/1985 | Whitman | 5/99.1 |
| 4,575,224 | 3/1986 | Saint | 5/99.1 |
| 4,688,280 | 8/1987 | Kohus et al. | 5/99.1 |
| 4,703,525 | 11/1987 | Shamie | 5/99.1 |
| 4,710,049 | 12/1987 | Chang | 5/99.1 |
| 4,739,527 | 4/1988 | Kohus et al. | 5/99.1 |
| 4,811,437 | 3/1989 | Dillner et al. | 5/99.1 |
| 4,812,348 | 3/1989 | Rau | 428/36.4 |
| 4,837,875 | 6/1989 | Shamie et al. | 5/99.1 |
| 4,843,664 | 7/1989 | Farnworth et al. | 5/487 |
| 4,985,948 | 1/1991 | Mariol | 5/99.1 |
| 5,024,866 | 6/1991 | Goode | 428/36.4 |
| 5,030,501 | 7/1991 | Colvin et al. | 5/455 |
| 5,081,723 | 1/1992 | Saunders | 5/93.1 |
| 5,197,154 | 3/1993 | Shamie | 5/99.1 |
| 5,211,498 | 5/1993 | Huang | 5/99.1 |
| 5,228,154 | 7/1993 | Brevi et al. | 5/99.1 |
| 5,239,714 | 8/1993 | Huang | 5/99.1 |
| 5,242,724 | 9/1993 | You | 428/36.4 |
| 5,243,718 | 9/1993 | Shamie | 5/99.1 |
| 5,324,558 | 6/1994 | Muto et al. | 428/36.4 |
| 5,385,767 | 1/1995 | Noguchi | 428/36.4 |
| 5,454,124 | 10/1995 | Huang | 5/99.1 |
| 5,457,828 | 10/1995 | Huang | 5/99.1 |

OTHER PUBLICATIONS

Consumer Reports, May, 1993, p. 288 "How to Buy a Portable Crib".

*Primary Examiner*—Alexander Grosz
*Attorney, Agent, or Firm*—William A. Simons

[57] ABSTRACT

Playpen and crib construction which utilizes a high modulus fiber-reinforced plastic matrix tubing in the frame, said tubing being made of lightweight, high modulus fiber-reinforced plastic matrix composite tubing having a weight of 0.25 pounds or less per lineal foot and wherein said plastic matrix is a thermoplastic resin or thermoset plastic resin with a minimum modulus of 250,000 psi; a minimum tensile strength of 6,000 psi; and a glass transition temperature of at least 50° C. and wherein said high modulus fiber reinforcement is selected from the group consisting of carbon fibers, aramid fibers, glass fibers, polyolefin fibers, boron fibers and mixtures thereof.

16 Claims, 10 Drawing Sheets

CHILD AND INFANT ENCLOSURE STRUCTURE COMPRISED OF TUBING SECTIONS OF LIGHTWEIGHT, HIGH MODULUS, FIBER REINFORCED PLASTIC MATRIX COMPOSITE

BACKGROUND OF THE INVENTION

1. Field of the Invention

The present invention relates to child and infant enclosure structures (e.g., playpens, cribs, play yards, bassinets and other similar enclosures). In particular, the present invention relates to child and infant enclosure structures made of a selected composite tubing or having a floor structure made of a selected construction. The present invention also relates to child and infant enclosure structures having certain hinge assemblies for folding and storing these enclosure structures.

2. Brief Description of the Art

Most infant's and children's playpens and cribs are currently constructed using steel, aluminum, or other metal tubular frames. These materials, in their usual form, provide the requisite strength and stiffness required to satisfy the physical demands of the application. The use of tubing, as described by the prior art, allows for a foldable design that is both practical and yet employs a minimal use of the specified structural materials. Recent examples of portable or foldable playpens and cribs include the following:

U.S. Pat. No. 3,800,341 (Davanzo) teaches a portable and collapsible playpen or crib made of plastic construction.

U.S. Pat. No. 4,491,992 (Frederick Whitman) describes a convertible baby crib and playpen. Specifically, this reference discloses an adjustable-sized, readily assembled and readily disassembled baby crib made up of a series of plastic tube sections and plastic tube fittings.

U.S. Pat. No. 4,575,224 (Saint) teaches a foldable playpen having frame portions and platform sections which pivot in opposite directions as leg frames move between extended and collapsed positions.

U.S. Pat. No. 4,688,280 (Kohus et al.) describes a foldable playpen having a base frame including a central hinged byfold hub attached to form horizontal floor support bars, each of which, in turn, are connected to a vertical corner frame member.

U.S. Pat. No. 4,703,525 (Shamie) is directed to a foldable playpen frame wherein four floor support members are connected together in a central socket hinge means. The floor members are also connected at their other ends to vertical upright members are connected to two pairs of cross members.

U.S. Pat. No. 4,710,049 (Chang) describes a foldable infant play yard containing a specifically defined safety hinge covered with padding material to prevent injury to the infant.

U.S. Pat. No. 4,739,527 (Kohus et al.) teaches a foldable playpen assembly that contains a central hub under the floor of playpen linked to at least four vertical support legs spaced outwardly from the hub. The linkage between the hub and the vertical support legs being adapted to maintain the legs in a first expanded spaced array when in use and to be moved to second contracted compact array in which the legs are much closer to the central hub when being stored or transported.

U.S. Pat. No. 4,811,437 (Dillner et al.) is directed to a foldable play yard comprising a foldable upper frame assembly and a foldable lower frame assembly with corner legs freely interconnecting to the upper and lower frame assemblies. The upper frame assemblies contain pairs of in-line upper side rails which are pivotally coupled at their outer ends to adjacent lower rail connecting members and at their inner ends to a medial rail connecting member. The medial rail connecting mechanism either houses a hand releasable latch mechanism or a rotatable latch mechanism for latching and releasing the said rail pairs into or from the in-line position. The lower frame assembly comprises a unitary central hub member, hub legs each pivotable coupled at one end portion thereof to said hub member and pivotally coupled at an opposite end position thereof to a lower frame assembly corner leg connecting members. When the play yard is erected and in use, the hub legs and side rails maintain the corner legs and side rails upstanding in a spread configuration. When the play yard is in storage or being transported, the hub legs and side rails are collapsed and draw the corner legs towards the hub member and into a compact configuration.

U.S. Pat. No. 4,877,875 (Shamie et al.) is directed to a foldable playpen having a plurality of floor supports connected at a central hub means. The plurality of the floor supports connected at their other ends to lower corner hinge means. These lower corner hinge means also connected to upright support means. The upper ends of said upright support means are connected to a plurality of cross-members, each connected between adjacent pairs of uprights. At least some of said cross-members having bending means permitting bending of said at least some of said cross-members.

U.S. Pat. No. 4,985,948 (Mariol) teaches a foldable play yard comprising the combination of (a) an essentially rectangular upper support formed of four pairs of rods each centrally coupled by a hinge, (b) an essentially rectangular lower support formed of four pairs of rods, each centrally coupled by a hinge; (c) four vertical rails interconnecting the corners of the upper and lower supports; and (d) a unitive fabric assembly comprising four vertically disposed panels each coupled between a pair of rods of the upper support and lower support and adjacent vertical rails, the fabric assembly also including a lower horizontal panel stitched to the vertically disposed panels and coupled between the rods of the lower rectangular support.

U.S. Pat. No. 5,081,723 (Saunders) teaches a playpen with detachable sides. This patent states that the sides and other components of this invention may be made from plastic, lightweight metal, fiberglass, wood, or other suitable materials and the body or webbing may be made from mesh such as vinyl-coated wire mesh, fabric, cloth, plastic, or fiber mesh.

U.S. Pat. No. 5,197,154 (Shamie) describes a foldable playpen containing a lower frame assembly including first and second auxiliary lower floor support legs, an inverted U-shaped bracket which pivotally connects inner ends of the lower auxiliary floor support legs together for movement between the first in-line position and a second folded position where the auxiliary lower floor support legs are substantially parallel with each other, and four lower floor support rails having inner and outer ends, the inner end of each lower floor support rail being pivotally connected to a substantial mid-point of a respective lower auxiliary floor support leg by means of a bracket plate for movement in a second plane substantially traverse to the first plane.

U.S. Pat. No. 5,211,498 (Huang et al.) describes a specifically designed folding joint for a foldable play yard.

U.S. Pat. No. 5,228,154 (Brevi et al.) teaches a foldable cot or playpen having a shaped lower support frame.

U.S. Pat. No. 5,239,714 (Huang) teaches a foldable playpen structure having a floor assembly consisting of (a) four bars respectively pivotally linking to lower corner connections and (b) a central joint comprising two pivotally joined halves wherein one half pivotally to two of the bars while the remaining half pivotally links to the remaining two bars; and an auxiliary foot pivotally linked to one of the halves so that said auxiliary foot is retained vertical for supporting said bars when said halves are laid in the same horizontal plane.

U.S. Pat. No. 5,243,718 (Shamie) teaches a foldable playpen having a specifically designed securing means for attaching rail sections in the upper frame and a lower frame assembly including a central hub having two sections hinged together.

U.S. Pat. No. Des. 304,523 (Dillner et al.) describes a foldable play yard having a floor frame assembly having a central hub and six floor-supporting legs connected to said hub.

Consumer Reports (May, 1993) page 288 lists several considerations when buying a portable crib. Those include light weight; ease of assembly and disassembly; ease of storing and transporting; and lack of sharp edges, finger entrapments or small parts.

The standard methods of constructing metal tubular playpens and cribs involve cutting the metal tubing the required lengths, punching out the required holes for fittings, and then fastening the tubing together in a design that provides for the convenient folding, storage, and transportation of the playpen.

The use of metal tubing currently infers a high degree of quality that other materials such as plastics do not convey. Separately, the use of metal tubing, versus metal plates or solid rods or other solid metal forms, allows for some weight minimization that would not otherwise be possible and also provides for playpen or crib designs that can be easily and conveniently folded, stored, and transported.

Unfortunately, the use of metal tubing in a playpen or crib results in a still relatively heavy product. The use of metal tubing also requires the use of connective fittings and hinges that may themselves constructed of metal or partially metal parts. These add to the weight of the product and make it less convenient to fold, store, and transport. Metal parts also require complicated coatings or treatments to minimize or prevent corrosion, even under ambient humidity conditions. Corrosion results in weakened parts which may unexpectedly fail. These corroded surfaces and chemical coatings may also be highly toxic to the infants. Such pretreatments necessary to coat the metal are also time intensive and relatively expensive, thus lengthening the production time and cost of the product.

Thermoplastic and thermoset plastic tubes of similar dimensions to these metal tubes have alternatively been considered for this use. It is noted that the use of thermoset or thermoplastic tubing or rods would allow for weight minimization that would not otherwise be possible with metal parts. Additionally, the use of thermoset or thermoplastic tubing or rods versus rigid thermoset or thermoplastic plates, mesh or other forms also would provide for playpen or crib design that could be easily and conveniently folded, stored, and transported. However, most economical plastics do not possess the required stiffness to maintain long term dimensional stability. Under the loads required by ASTM Test Method F406 for playpens, the most economical thermoplastics will deflect and even permanently deform or break. Such properties are not acceptable and pose a significant risk to an infant. Specifically, their relatively poor physical strength and stiffness require thicker walled tubes or even solid rods. Such tubes or rods dramatically increase the weight of the product. Additionally, the use of plastics in general also infer a lack of quality or "cheapness" that further detracts from their use as primary structural materials in such products. Moreover, while plastics do not corrode and do not usually require the use of coatings or pretreatments, coating plastics is time-intensive and relatively complicated and again causes more expensive and longer production times.

Certain composite materials have properties that preclude their use for playpen or crib applications. For example, ceramic-metal and wood-thermoset plastic composites have the disadvantage of their relative heavy weight. In this regard, it is noted that U.S. Pat. No. 3,916,802 states that an infant dressing table " . . . may be constructed of wood or fiber composite materials". It is also noted the reference does not provide any teaching of any preferred type of fiber composite material of the present invention. Glass fiber reinforced polyester matrix composites are an improvement of the aforementioned composites, but these latter materials are relatively thick and bulky.

A significant benefit would be achieved by employing a material that did not require substantially thickening or ribbing to achieve the required strength and rigidity. It would be even better still if a material could be found which could be thinner than unreinforced plastic in the structural components of playpens and cribs.

Based upon the above, a need clearly exists for a playpen design that employs lightweight, durable, strong, stiff, non-corroding parts that feel and sound like metal, and allow for a design that is itself lightweight, of consistent quality, safe, durable and easily folded, stored, and transported, all at a relative low cost. The previously mentioned prior art does not provide for the combination of all of the above properties. Such an invention would be highly beneficial to the users of playpens and cribs. It has now been found that the various aspects of the present invention meet this need.

BRIEF SUMMARY OF THE INVENTION

Specifically, one aspect of the present invention is directed to a child or infant enclosure structure comprising a base and a multiside enclosing frame wherein said frame comprises tubing sections made of lightweight, high modulus fiber-reinforced plastic matrix composite tubing having a weight of 0.25 pounds or less per lineal foot.

A second aspect of the present invention is directed to a child or infant enclosure structure comprising a base and a multiside enclosing frame wherein said base is a multilayer construction comprising the combination of (a) a foam cushion mattress pad on top of (b) a high tensile strength film skin on top of; (c) core material on top of; (d) a high tensile strength film skin.

A third aspect of this invention is directed to a foldable child and infant enclosure frame comprising:

(a) a plurality of collapsible upper rails, each upper rail comprised of two tubing sections and a centrally located hinged collar assembly for releasably maintaining each said upper rail in a non-collapsed position; said hinged collar assembly comprising (i) two tubing extensions, each tubing extension protruding from one of said tubing extensions; (ii) a hinge; (iii) two collar halves attached together by said hinge and overlaying and rotatable around said two tubing extensions; (iv) a locking mechanism for holding said hinged collar assembly and tubing sections in a locked non-collapsible straight horizontal axis when said hinge and said collar halves are rotated around said tubing extensions to a first position; said locking mechanism releasable by rotating said hinge and said collar halves to a second position, thereby allowing said upper rail to be collapsible (b) a lower frame assembly;

(c) a plurality of vertical corner legs; each corner leg having an upper end and a lower end;

(d) a plurality of upper corner connections for interconnecting adjacent upper rails and said upper end of said corner legs together; and (e) a plurality of lower corner connections for interconnecting said lower ends of corner legs and lower frame assembly together.

A fourth aspect of this invention is directed to a foldable child and infant enclosure frame comprising:

(a) a plurality of collapsible upper rails;

(b) a plurality of vertical corner legs, each corner leg having an upper end and a lower end;

(c) a plurality of upper corner connections for interconnecting adjacent upper rails and said upper ends of corner legs together;

(d) a plurality of lower rails having inner ends and outer ends;

(e) a plurality of lower corner connections for interconnecting the lower ends of said corner legs to the outer ends of said lower rails; said lower rails capable of pivoting upwardly at said lower corner connections; and (f) a central hub assembly comprising (i) a central hub foot having a plurality of openings for said plurality of lower rails; (ii) a central hub top; and (iii) a ring positioned between said central hub foot and said central hub top; said inner ends of said lower rails interconnected to said ring and capable of being pivoted downwardly in said openings when said central hub assembly is raised.

Other aspects of the present invention involves combinations of these first four aspects of the present invention.

BRIEF DESCRIPTION OF THE DRAWINGS

The present invention may be better understood by reference to the following detailed description and to the accompanied drawings in which.

DETAILED DESCRIPTION OF THE PREFERRED EMBODIMENTS

Figure 1B:
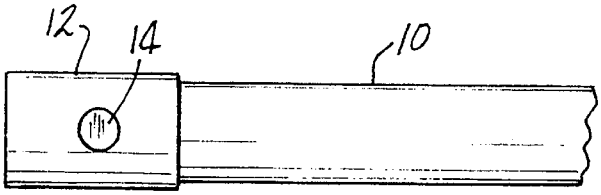
FIG. 1B is a side view of the same tubing section having an external metal ring reinforcement.

The term "composites" as used in the present specification and claims is defined as those materials found by distributing extremely strong and stiff, continuous, chopped, or a mixture of fibers in a polymer resin matrix or binder.

The term "high modulus fiber reinforcement" as used in the present specification and claims is defined as a collection of fibers employed possessing an average modulus of at least 5,000,000 psi, preferably 15,000,000 psi, and most preferably at least 30,000,000 psi.

The term "plastic resin matrix or binder" as used in the present specification and claims is defined as any thermoset or thermoplastic resin with a minimum modulus of about 250,000 psi, preferably about 325,000 psi, and most preferably, at least about 400,000 psi; a minimum tensile strength of about 6,000 psi, preferably about 10,000 psi, and most preferably at least about 12,000 psi; and glass transition temperature (Tg) of at least about 50° C., preferably at least about 75° C., and most preferably, at least about 100° C.

Preferred examples of higher modulus fiber reinforcement material include carbon fibers, aramid fibers, glass fibers, polyolefin fibers, boron fibers, and the like. Most preferred is carbon fibers alone or with combination with other fibers.

Preferred examples of the plastic resin matrix or binder include plastic resins such as nylon, high-strength polyethylene, liquid crystalline polyethylene, epoxy resins, cyanurates, polyesters, and polyurethanes and the like. Most preferred is epoxy-type thermoset resins and nylon-type thermoplastic resins.

Generally, the high modulus fibers used herein are typically at least about 50 times stronger and at least about 20–150 times stiffer than the plastic resin matrix used herein. The role of the matrix is primarily that of a glue or binder that enables the high modulus fibers to support the applied loads.

In the composites used in the present invention, the ratio of high modulus fibers to plastic resin mixture is preferably from 30:70 to 70:30 by volume, more preferably, 40:60 to 60:40 by volume.

Fiber angles of the composite tubing should be a combination of high and low angles to the axis of the tube to impart maximum rigidity and strength per unit weight. The angle combination should be preferably isotropic winging angles.

Overall tubing weight should be no more than 0.25 pounds per lineal foot, preferably no more than 0.17 pounds per lineal foot, and most preferably no more than 0.10 pounds per lineal foot.

The high modulus fibers and plastic resin matrix or binder combined to form composites used in the present invention by any standard composite fabrication technique. Filament winding is one technique of tube construction when maximum lightness and continuous fiber reinforcements are needed along with maximum superior strength and stiffness for a given fiber volume fraction. Alternatively, the construction technique may be pultrusion, injection molding, or any other standard composite tubular construction technique. Also, the present invention encompasses the use of the above-noted composites with additional tubular material, such as a composite covering an ultrathin tube or plastic tube. The present invention also encompasses the use of the above-noted composites in tapered shafts (i.e., wherein one end of the tubing has a larger diameter than the other end.

The composite tubings of the present invention as well as the connective fittings, supports, and folding mechanisms described herein may be made of any suitable materials, including molded plastics containing lightening fillers, such as microballoons and other low-density fillers, whose density is no more than 0.9 grams per cubic centimeter.

This invention has many unique and significant advantages over the prior art. In contrast to using either metal, thermosetplastic tubing, or thermoplastic tubing, using high modulus fiber plastic matrix reinforced composite tubing results in a dramatic reduction in frame weight without a loss of strength. This weight loss, without a loss in strength, provides for a playpen or crib that can be easily and conveniently folded, stored, and transported. The use of high modulus fiber plastic matrix reinforced composite tubing or rods, versus high modulus fiber plastic matrix reinforced composite tubing or rods, versus high modulus fiber plastic matrix reinforced composite plates, mesh, or other form allows for weight minimization that would not otherwise be possible. The use of high modulus fiber plastic matrix reinforced composite tubing or rods, versus high modulus fiber plastic matrix reinforced composite plates, mesh, or other form also provides for playpen or crib design that can be easily and conveniently folded, stored, and transported. The dramatic weight reduction coupled with the tubular form also allows for the use of less dramatic weight loss coupled with the tubular form also allows for the use of less strong and lighter connective fixtures and hinges. These properties again provide for a playpen or crib design than can be easily and conveniently folded, stored, and transported. Long, high modulus fiber/plastic matrix reinforced composites are desired over short, high modulus fiber plastic matrix reinforced composites because of their overall superior strength and stiffness. Oriented, long, high modulus fiber plastic matrix reinforced composites are even more preferred because of their even more superior strength and stiffness. Additionally, high modulus fiber plastic matrix reinforced composites, because of their high stiffness, dimension stability, and acoustic properties, do not dampen or significantly distort sound. Accordingly, unlike unreinforced plastics or short, high modulus fiber/plastic matrix reinforced composites, high modulus fiber plastic matrix reinforce composites have metal-like properties and infer a quality appearance. Unlike metals and more easily than most plastics, composites may be readily coated for decorative purposes and will not corrode.

Now turning to the drawings, the preferred playpen and crib designs may be seen from FIGS. 1 to 21.

Figure 1A:
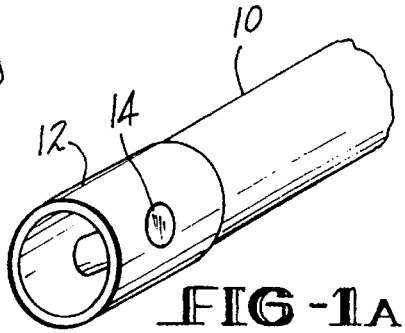
FIG. 1A is a perspective view of a tubing section that may be employed in making cribs or playpens of the present invention, said tubing section having an external metal ring reinforcement.
Figure 1C:
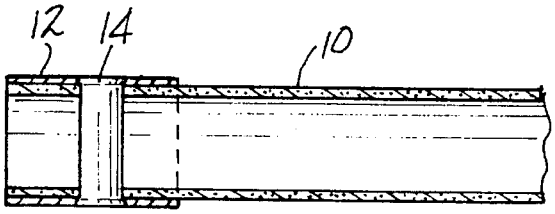
FIG. 1C is a cross-sectional view of the same tubing section having an external metal ring reinforcement.

FIGS. 1A, 1B, and 1C illustrate composite tubing 10 with metal rings 12 reinforcing one end. The metal ring 12 is held in place by means of a rivet 14 or an adhesive. Instead of metal rings, plastic rings of the like may be used. The reinforced ends of the composite tubes 10 are preferably used in the corner connections of the assembled crib or playpen frame.

Figure 2B:
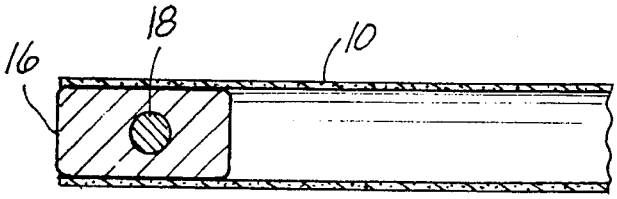
FIG. 2B is a side view of the same tubing section having an internal plug reinforcement.
Figure 2A:
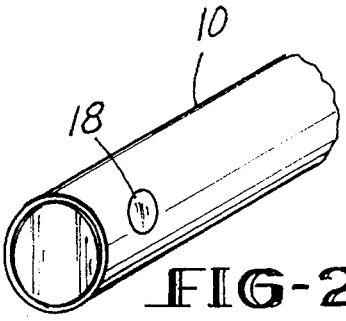
FIG. 2A is a perspective view of a tubing section that may be employed in making cribs and playpens of the present invention, said tubing section having an internal plug reinforcement.
Figure 2C:
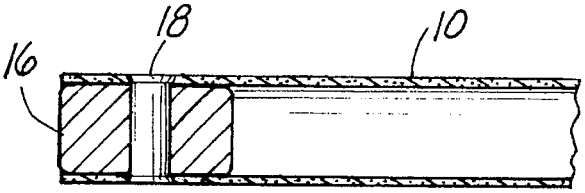
FIG. 2C is a cross-sectional of the same tubing section having an internal plug reinforcement.

FIGS. 2A, 2B, and 2C illustrate composite tubing 10 having internal plug reinforcement 16 at one end. The plug reinforcement 16 is held in place with a rivet 18 or an adhesive. Plastics and other reinforcement materials such as polyethylene may be used instead of metal. These alternative reinforcement plugs 16 may also be used to reinforce the ends of composite tubing at the corner connections of the crib or playpen frame.

Figure 3A:
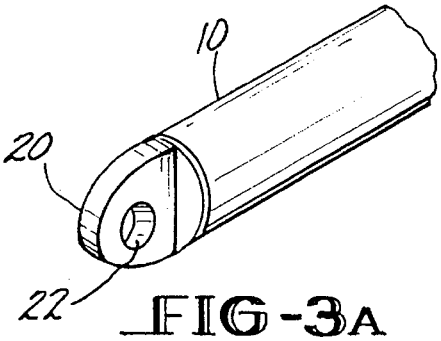
FIG. 3A is a perspective view of a tubing section that may be employed in making cribs and playpens of the present invention, said tubing section having an end connective fitting which minimizes point loading on the tubing.
Figure 3B:
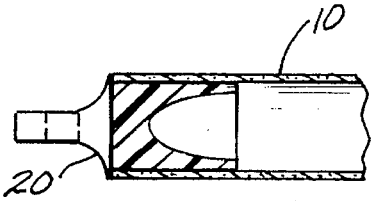
FIG. 3B is a side view of the same tubing section having an end connective fitting.
Figure 3C:
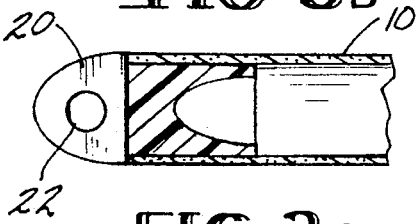
FIG. 3C is a cross-sectional view of the same tubing section having an end connective fitting.

FIGS. 3A, 3B, and 3C illustrate composite tubing 10 having a plastic end connective fitting 20. The fittings 20 may be made of any suitable plastic such as nylon, polyester, ABS, or the like as well as other materials. The fitting has a hole 22 that allows rivet or screw or other connecting means to attach the composite tubing 10 to the corner connection of the crib or playpen frame. Alternatively, the fitting 20 and tubing 10 may be held together by means of an adhesive. These Figures also illustrate the use of concave shaped internal fittings that minimize point loadings on the composite tubing. While the reinforcement means illustrated by FIGS. 1–3 are preferred ways of reinforcing the compositive tubing to the corner connections of the crib or playpen frame, other reinforcing means may instead be used.

Figure 4:
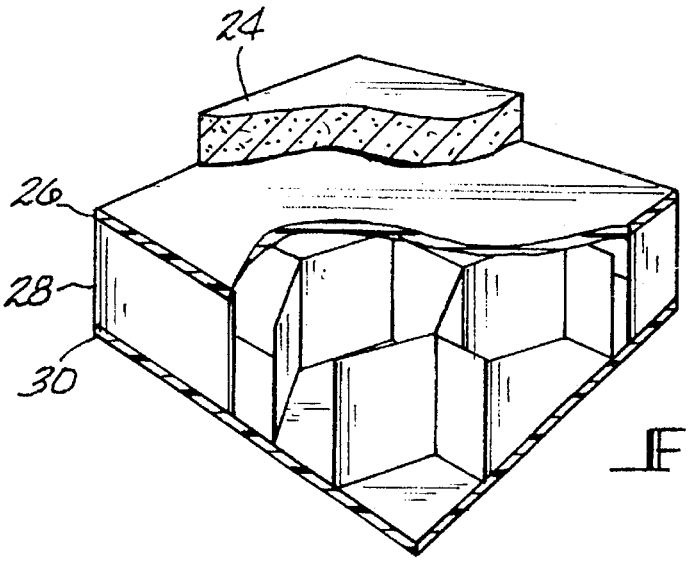
FIG. 4 is a cutaway isometric view of one preferred base that may be employed in making cribs and playpens of the present invention, said base having a honeycomb structure core material.

FIG. 4 shows one preferred base structure for cribs and playpens of the present invention upon which the infant or child can rest or play. This structure has a top foam cushion 24 lying on a high tensile strength film skin 26. A honeycomb structured core material 28 is under the skin 26 and on top of a similar high tensile strength skin 30.

The foam cushion 24 should be of a thickness to provide comfort to the child, but yet meet the safety standards set for cushioned bases in cribs and playpens. The high tensile strength skin film may be any material with a high tensile strength such as a thermoplastic film or kraft paper. Other suitable skin materials include thermoplastics such as polyethylene, polypropylene, nylon, and thermoset such as polyesters and epoxies. The honeycomb-structured core material is preferred because of its lightweight and good supporting strength. Preferred honeycomb materials include thermoplastics such as polyethylene, polypropylene, nylon, and thermosets such as polyesters and epoxies.

Figure 5:
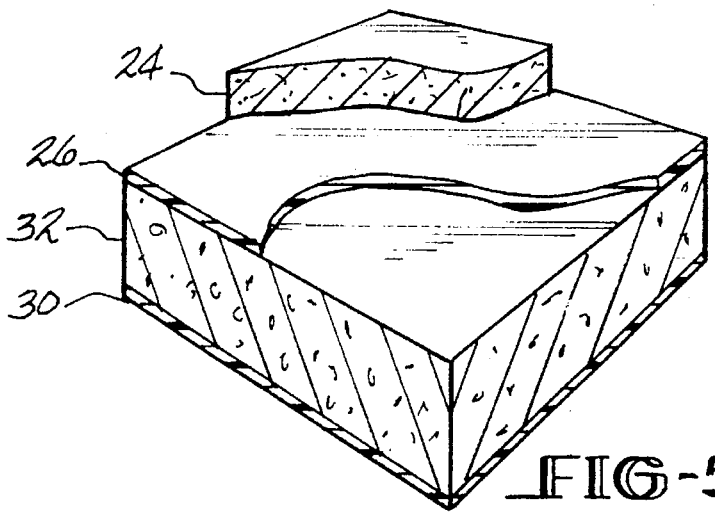
FIG. 5 is a cutaway isometric view of another preferred base that may be employed in making cribs and playpens of the present invention, said base having a solid foam core material.

FIG. 5 illustrates an alternative preferred base construction for a crib or playpen. This construction is similar to the base construction of FIG. 4 in that foam cushion 24 and skin films 26 and 30 are also employed. Instead of honeycombed core material 28, this embodiment uses a rigid foam core material 32. The rigid foam core material 32 may be any suitable material having a rigid cellular network such as a rigid polyurethane or balsa wood. Other suitable rigid foam core material include polystyrene, polyisocyanurates, and polyurethanes, preferably in thermoset form.

Figure 6:
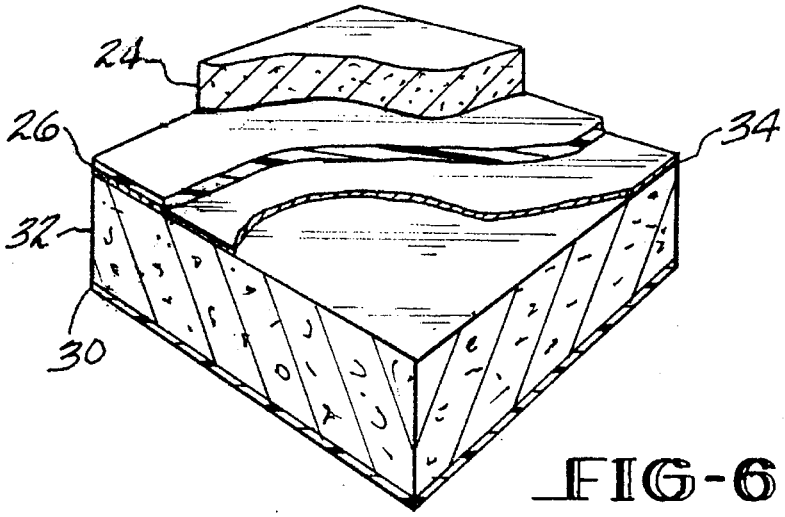
FIG. 6 is a cutaway isometric view of still another preferred base that may be employed in making cribs and playpens of the present invention, said base having a solid foam core material and a composite sheet overlying that core material.

FIG. 6 shows another alternative preferred base construction. This construction is similar to the base construction of FIG. 5 in that foam cushion 24, skin films 26 and 30, and rigid foam core material 32 are present. In addition, this embodiment has a layer of composite material 34 between skin layer 26 and core material 32. This added layer of composite material provided added strength to the base. The preferred composite material is a carbon fiber composite web. The composite sheet or melting may be made of the previously described carbon fiber composites employing the previously described methods to prepare a sheet or netting of this material.

Figure 7:
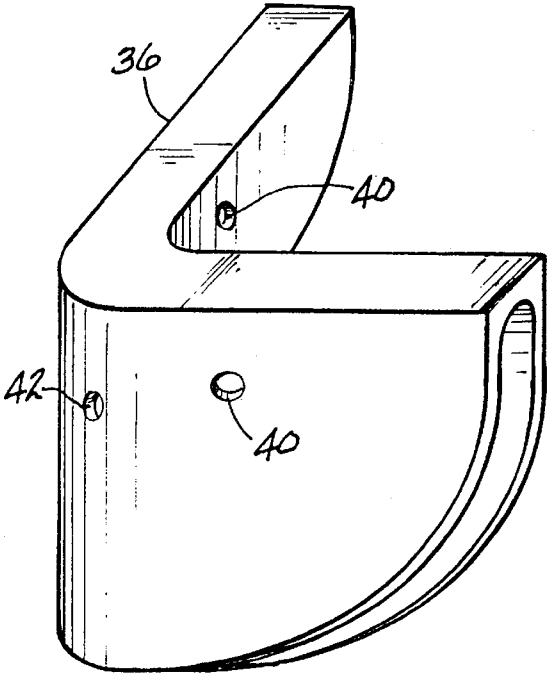
FIG. 7 is a preferred upper corner connection of cribs and playpens of the present invention.

FIG. 7 illustrates an upper corner connection 36 for the crib or playpen. The corner connection is used to connect adjacent tubing 10 together. The crib or playpen frame preferably has four (4) upper corner connections 36 (see FIG. 21). These corner connections 36 are preferably made from molded plastic. The horizontal tubings 10 are held in the upper corner connection 10 by means of rivets or screws or other connecting means that pass through holes 40. The vertical tubing 10 are held in the upper corner connection by the same type of connecting means that pass through hole 42. As can be seen in FIG. 7, the ends of horizontal tubings 10 can move around the point indicated by hole 40 when the crib or playpen frame is folded up. In that situation, the tubings 10 will then move downward through opening 44 until they are approximately parallel to the vertical tubings 10. Also, one or more of these upper corner connections 36 may have openings for securing the playpen or crib to another object (e.g., railing or tree or post).

Figure 8:
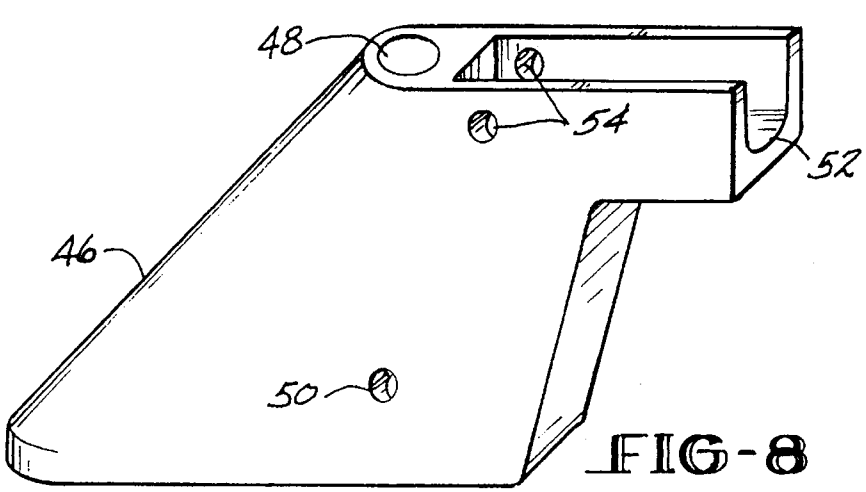
FIG. 8 is a preferred lower corner connection and base for cribs and playpens of the present invention.

FIG. 8 is a preferred lower corner connection and base 46. The vertical tubing 10 connected to the upper corner connection 36 passes through opening 48 and is held in place by standard connecting means that pass through hole 50. Concurrently, lower tubings 10 (see FIG. 21) are held in place in channel 52 by standard connecting means that pass through holes 54 and are allowed to pivot upward. Also, one or more of the lower corner connection 46 may have opening (not shown) for either holding means to secure the frame to the ground (e.g., a vertical opening to hold a spike or the like) or to another object (e.g., a horizontal opening to hold a rope that could be attached around a post, tree, or the like).

Figure 9:
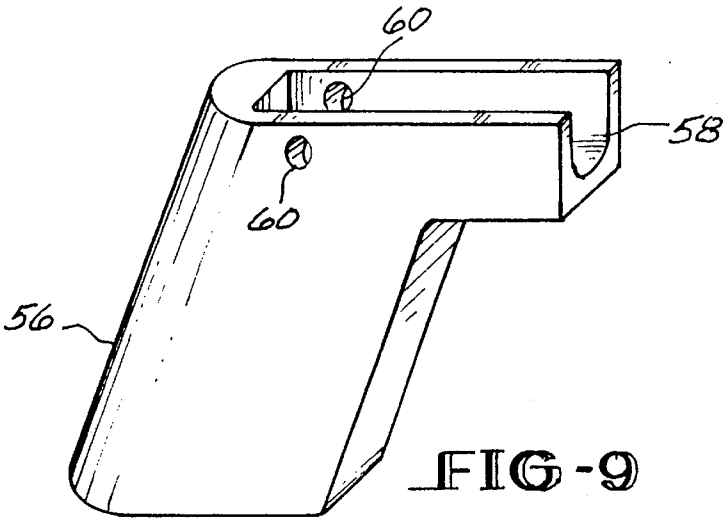
FIG. 9 is a preferred lower center base for cribs and playpens of the present invention.

FIG. 9 illustrates a preferred lower side base 56 that holds lower side tubings 10 (see FIG. 21) in channel 58 and by a standard connective means that pass through holes 60. The lower side bases, like the upper and lower corner connections, may be made of any suitable molded plastic.

FIGS. 10A, 10B, 10C, and 10D show the cross-section of hinged collar assembly 62 that is composed of two tubing extension or extender rods 64 and 66, two hinged collar halves 68 and 70, hinge 72, and collar guides 74 and 76. The two tubing extender rods 64 and 66 extend out adjacent tubings 10. Preferably, these tubing extender rods 64 and 66 are made from plastic, fiber-reinforced plastics, or metal or the like. Similarly, the hinged collar halves 68 and 70 that cover the rods 64 and 68, respectively, are also preferably made of molded plastic, molded fiber-reinforced plastics, or shaped metal or the like. The collar halves 68 and 70 are joined together by means of hinge 72. The hinge 72 is plastic, fiber-reinforced plastic, or metal rod surrounded by alternating material of both halves 68 and 70. The collar guides 74 and 76 hold the collar halves 68 and 70 in place by joints 78 and 80. These joints 78 and 80 allow the collar halves 68 and 70 to rotate around extender rods 64 and 66. The collar guides 78 and 80 as well as extender rods are held stationary by means of rivets 82 and 84.

The extender rod 64 has spring 86 and locking button 88 that may pass through opening 90 in hinged collar half 68. Collar half 68 also has a locking extension 92. Extender rod has locking extension 94.

Figures 10A, 10B, 10C:
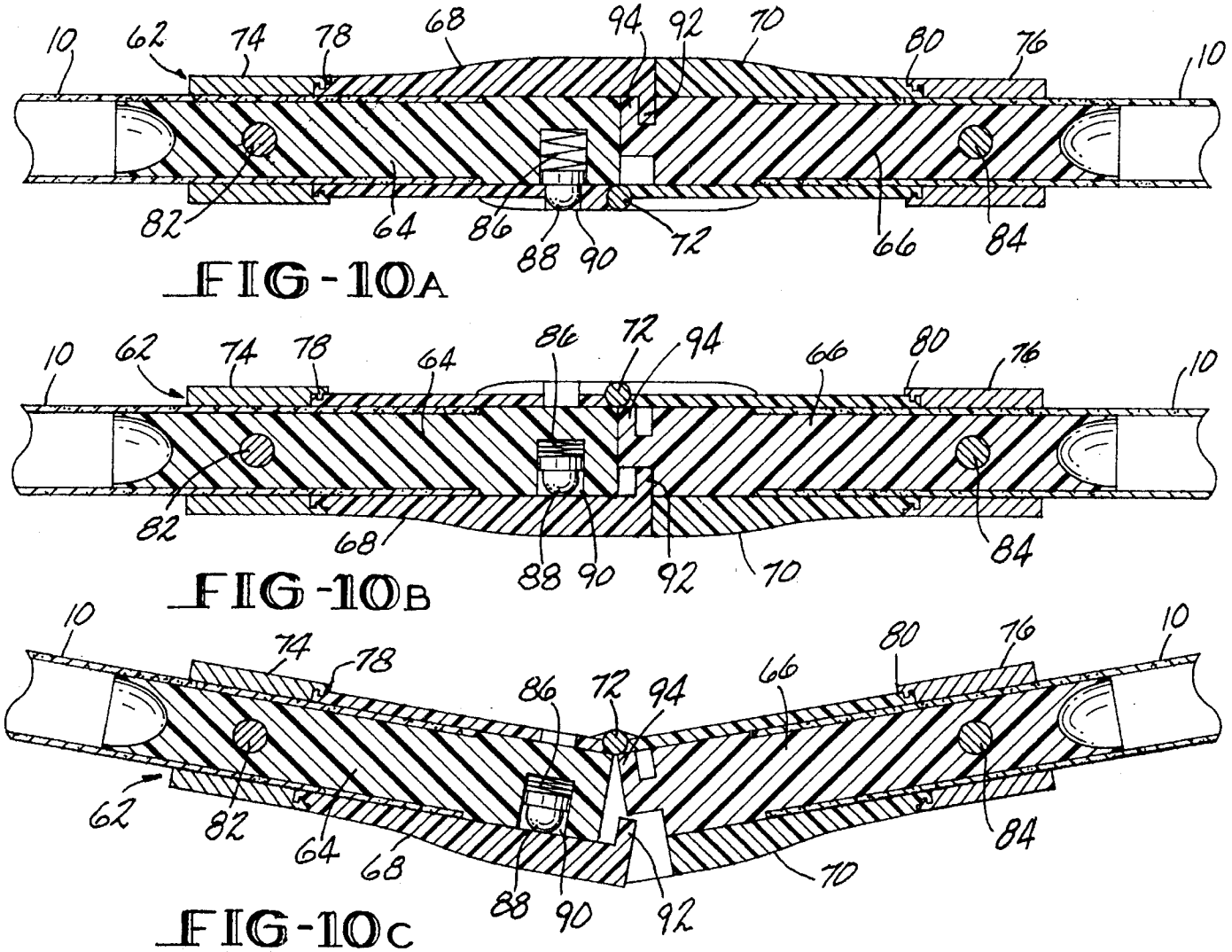
FIG. 10A is a cross-sectional side view of the hinged collar assembly for tubing sections of the present invention, wherein the hinge is in a locked and lengthwise (collapsed) position.
FIG. 10B is a cross-sectional side view of the hinged collar assembly for the tubing sections of the present invention wherein the hinged collar assembly is in an unlocked and lengthwise (collapsed) position.
FIG. 10C is a cross-sectional side view of the hinged collar assembly wherein the hinged collar assembly is an unlocked and slightly collapsed position.

During operation as illustrated by FIGS. 10A, 10B, 10C and 10D, the hinged collar assembly 62 may be held in a locked and lengthwise position (see FIG. 10A). At this time, the locking button 88 extends into opening 90 in hinged collar half 68 and locking extension 92 and locking extension 94 intersect and, thus, hold the two tubings 10 in a locked lengthwise position. This is the desired position when the crib or playpen is in use.

When it is time to fold and store the crib or playpen, the hinged collar halves 68 and 70 are moved from the locked position. This is accomplished by simply pushing the locking button 88 and rotating the hinged collar halves 68 and 70. The rotation of the hinged collar halves 68 and 70 causes the locking protrusions 92 and 94 to become not intersected (see FIG. 10*b*). Then the collar halves 68 and 70 are able to separate around hinge 72 (see FIG. 10C) and may be completely folded (see FIG. 10D).

Figure 11A:
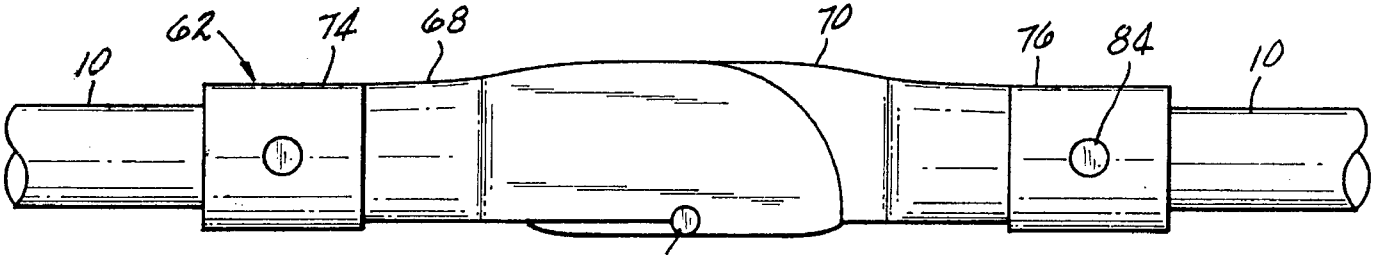
FIG. 11A is a side elevation view of the preferred hinged collar assembly in the same position as FIG. 10A, illustrating the outer hinged collar halves in the locked position.
Figure 11B:
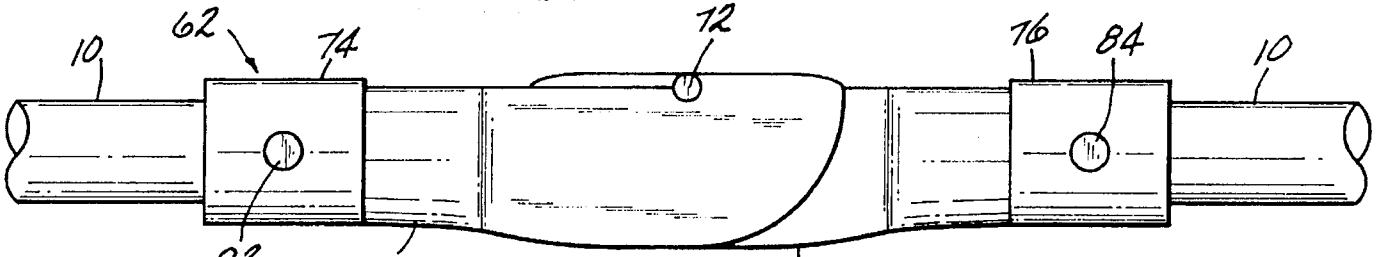
FIG. 11B is a side elevation view of the preferred hinged collar assembly in the same position as FIG. 10B, illustrating the outer hinged collar halves are rotated 180° and the assembly is in an unlocked, but not collapsed, position.
Figure 11C:
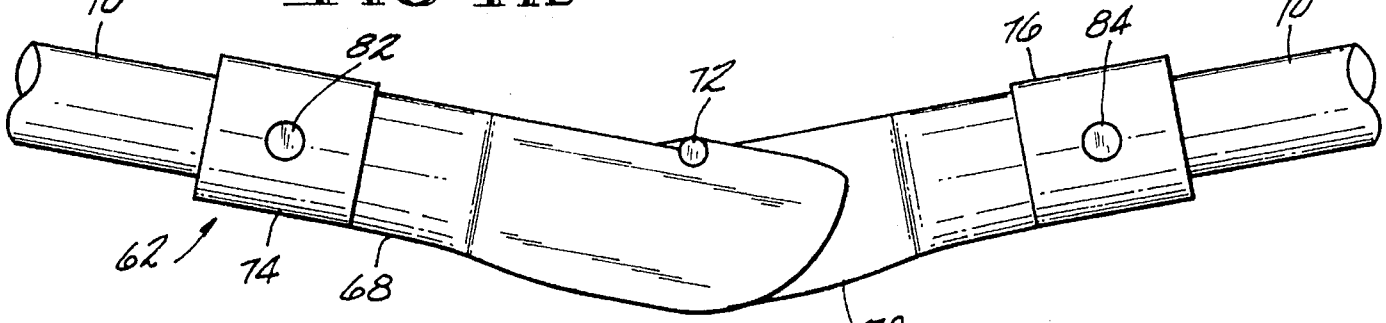
FIG. 11C is a side elevation view of the preferred hinged collar assembly in the same position as FIG. 10C, illustrating the hinged collar assembly in an unlocked and slightly collapsed position.
Figure 11D:
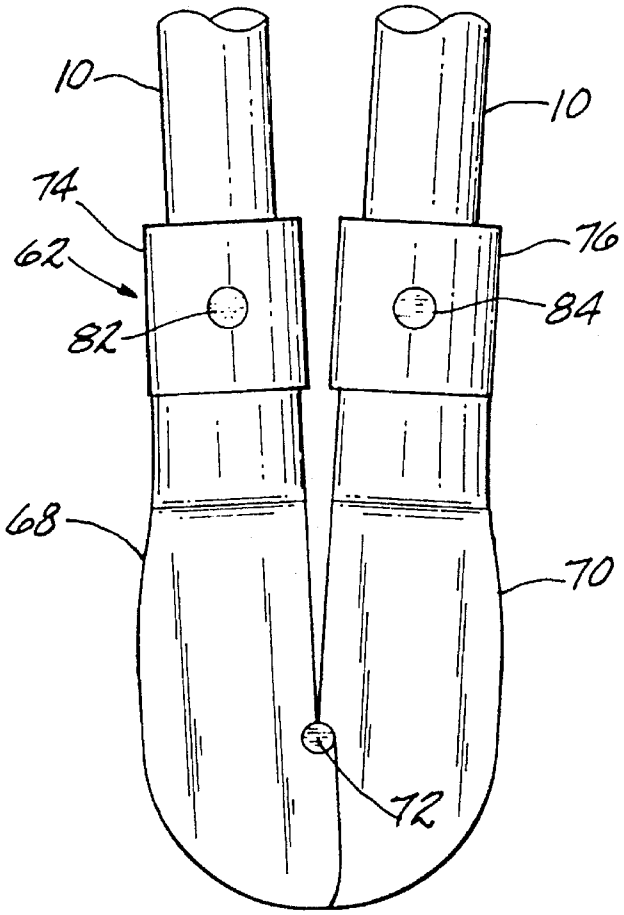
FIG. 11D is a side elevation view of the preferred hinged collar assembly in the same position as in FIG. 10D, illustrating the hinged collar assembly in an unlocked and totally collapsed or folded position.
Figure 10D:
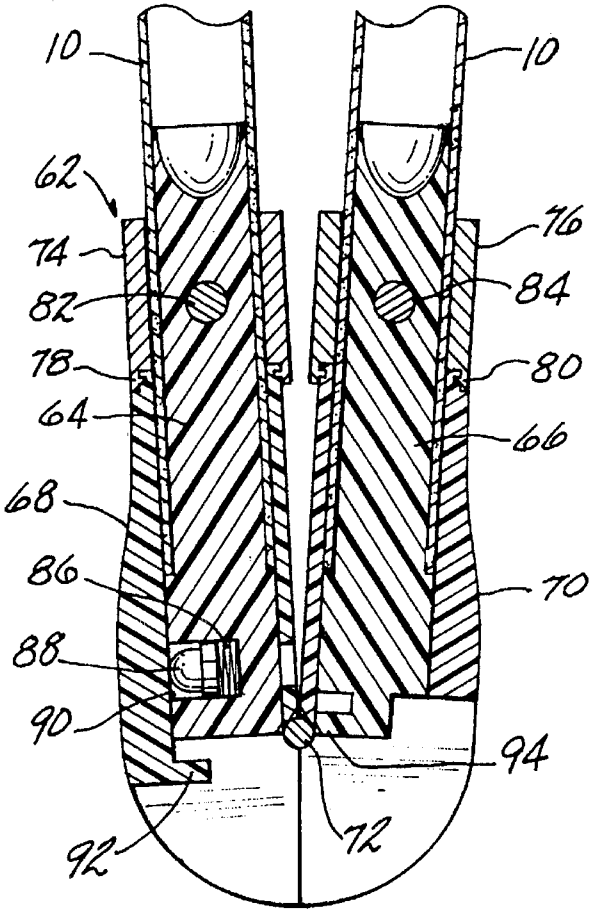
FIG. 10D is a cross-sectional side view of the hinged collar assembly in an unlocked and totally collapsed or folded position.

FIGS. 11A, 11B, 11C and 11D show the hinged collar assembly from an external side view. In FIG. 11A, the two collar halves 68 and 70 and tubings 10 are in the locked position around hinge 72 and secured by collar guides 74 and 76 and rivets 82 and 84. FIG. 11B shows the rotation of collar halves 68 and 70 and hinge 72 to the unlocked position. FIG. 11C shows the breaking of tubings 10 and collar halves 68 and 70 from the lengthwise position. FIG. 11D shows the hinged collar assembly in a completely folded position where the tubings 10 are approximately parallel to each other.

Figure 12:
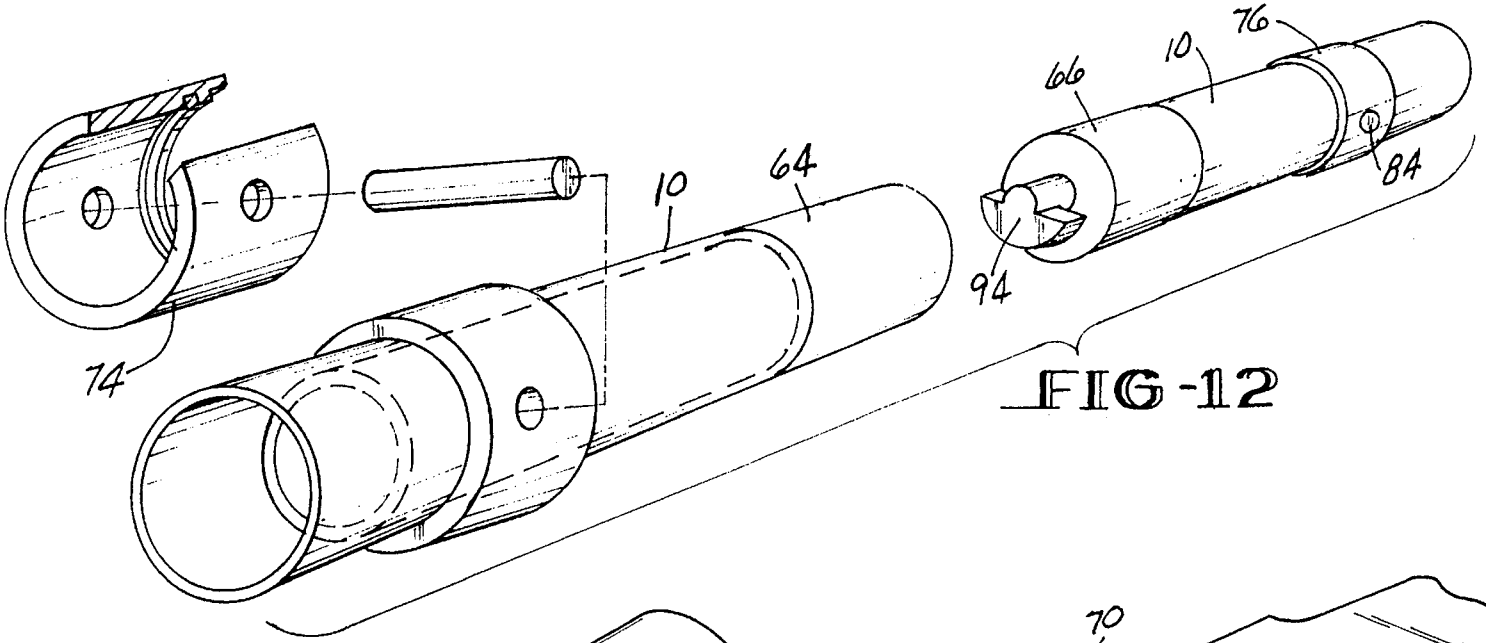
FIG. 12 is an exploded perspective view of a pair of preferred tubing extender rods that are secured to the tubing by means of plastic collar guides.

FIG. 12 shows a blown-up detailed view of the extender rod 66 within tubing 10 and secured by collar guide 76 and rivet 84 as well as exploded view of collar guide 74 and rivet 82 around tubing 10 and extender rod 64. In FIG. 12, extender rod 66 is shown with locking extension 94.

Figures 13, 16, 17:
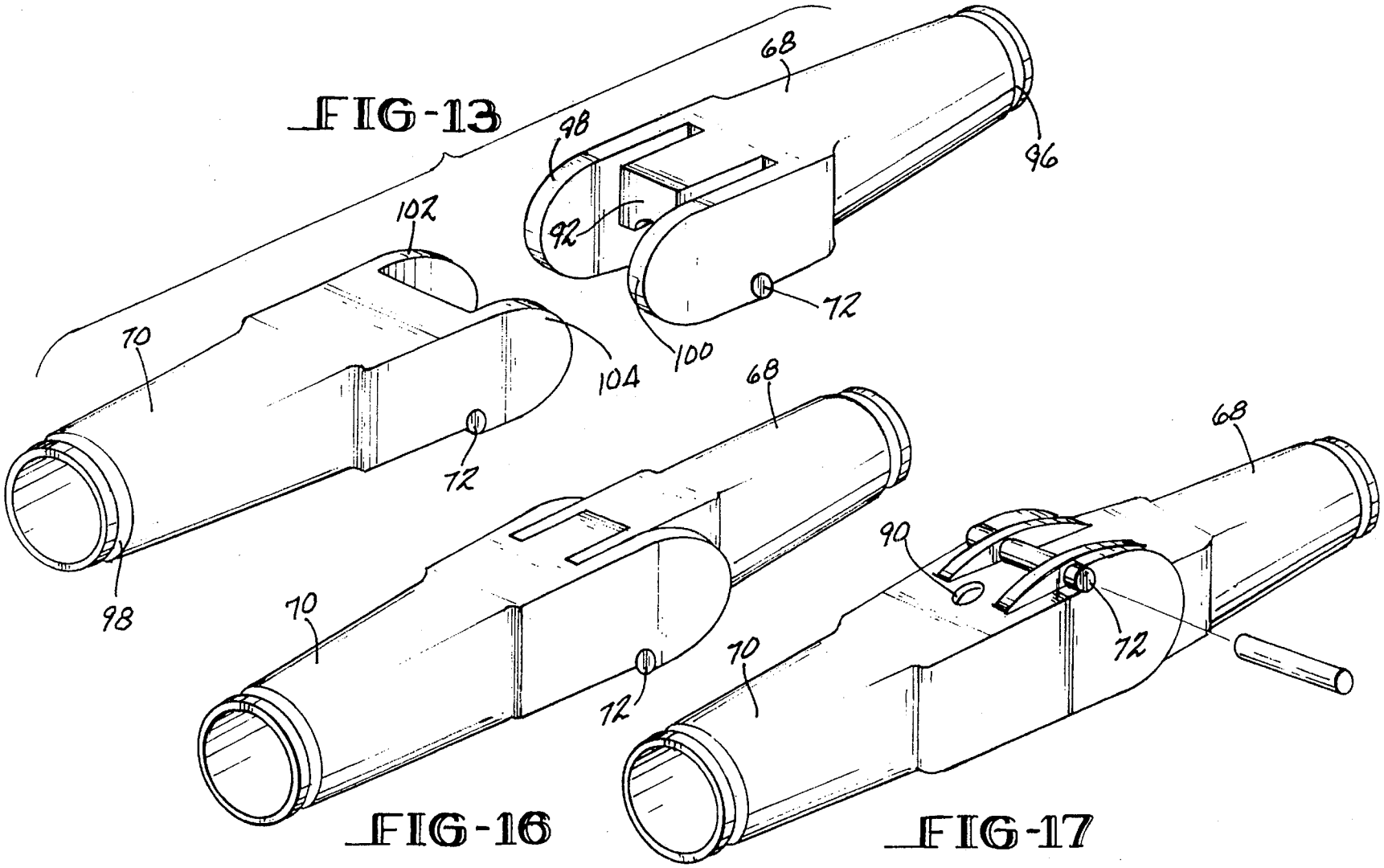
FIG. 13 is a perspective view of a pair of hinged collar assembly halves in a separated (and unhinged) position.
FIG. 16 is a perspective view of two outer hinged collar halves fitted together.
FIG. 17 is an exploded perspective view of two outer collar halves fitted together and showing the hinge rod removes.

FIG. 13 shows separated hinged collar halves 68 and 70. Collar halves 68 and 70 have locking grooves 96 and 98 to which collar guides 74 and 76 can secure each half. FIG. 13 also shows that hinged collar half 68 has two collars 98 and 100 and locking pretrusion 92 and hinged collar half 70 has two collars 102 and 104.

Figure 14:
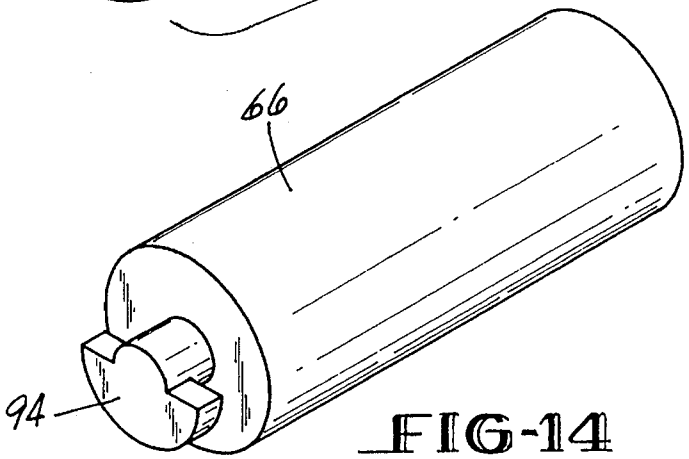
FIG. 14 is a perspective view of one preferred tubing extension with locking mechanism detail.

FIG. 14 shows tubing extension 66 with locking extension 94. Tubing extension 66 fits inside hinged collar half 70.

Figure 15:
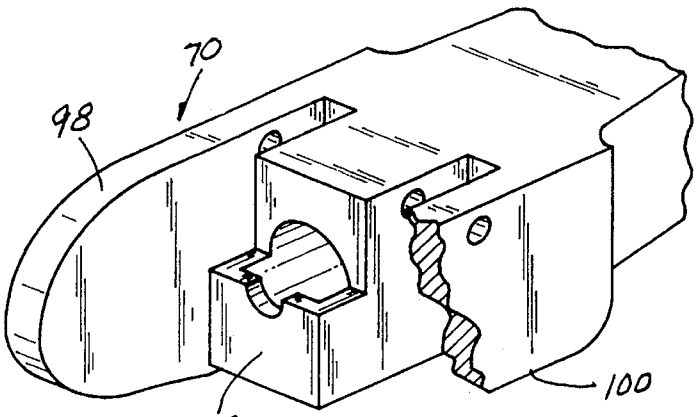
FIG. 15 is a perspective view of one preferred collar half having a locking mechanism detail.

FIG. 15 shows a detail of hinged collar halve 70. This detail shows collars 98 and 100 and locking extension 92.

FIGS. 16 and 17 show the two hinged collar halves 68 and 70 fitted together with collars 98, 100, 102 and 104 and locking extension 92 interlocking with hinge rod 72 through all four collars. FIG. 17 also shows opening 90 for locking button 88.

Figure 20:
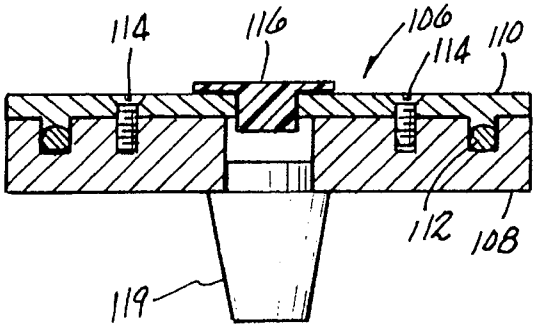
FIG. 20 is a side cross-sectional view of the center hub member assembly.
Figure 18:
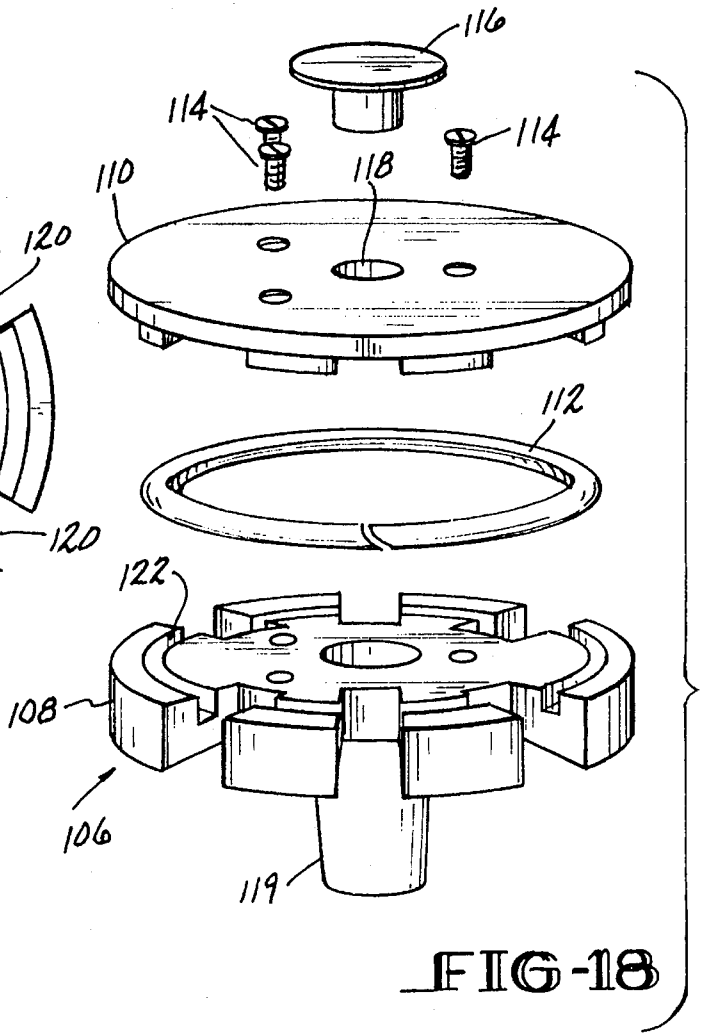
FIG. 18 is an exploded perspective view of a preferred central hub member assembly of the present invention.
Figure 19:
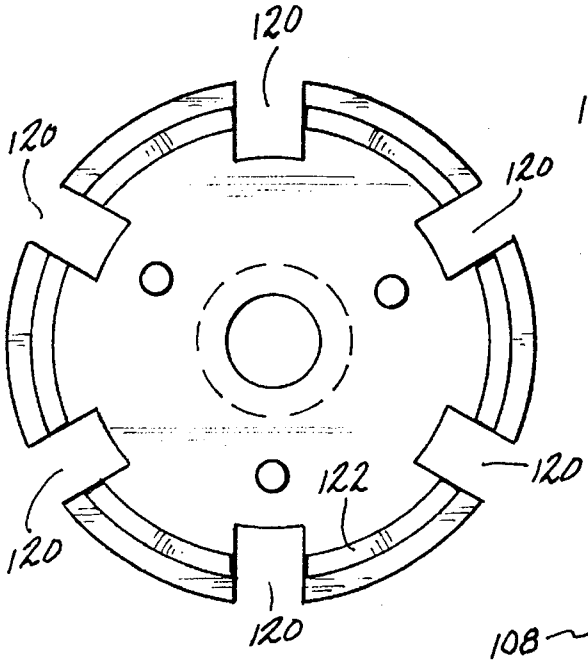
FIG. 19 is top view of a preferred center base foot element of the center hub member assembly of the present invention.

FIG. 18 shows an exploded view of central hub member assembly 106 wherein central hub foot 108, ring 110 and central hub top 112 are assembled together by means of screws 114. Cap 116 provides a means where the base construction or the cloth structure of the crib or playpen may be attached (i.e., the cap 116 passes through a hole in the base construction and then locks into the hole 118 in central hub top 112). Central hub foot 108 has a central supporting member 119 that provides support to the base in the center of the frame (see FIG. 21). FIG. 19 shows the top view of central hub foot 108 with the six openings 120 for the elongated tubing 10 to be inserted and to pivot around and the ring groove 122 in which ring 110 is placed. FIG. 20 shows an assembled cross-sectional view of this central hub member assembly 106. The central hub top 112 fits over the ring groove 122, thereby keeping ring 110 from moving.

In practice, the six lower tubings 10 are drilled with a hole at their ends opposite the lower corner connections and lower side bases (or optionally fitted with a connective fitting shown in FIGS. 3A, 3B, and 3C or reinforced with reinforcements shown in FIGS. 1 and 2). The ring 110 is then inserted through the holes in all six tubings 10 or in the holes 22 (their connective fittings 20). The ring 110 is then placed in ring groove 122 with each of the tubings being inserted into a space 120. Central hub top 112 is then attached to central hub foot 108 with screws 114.

Figure 21:
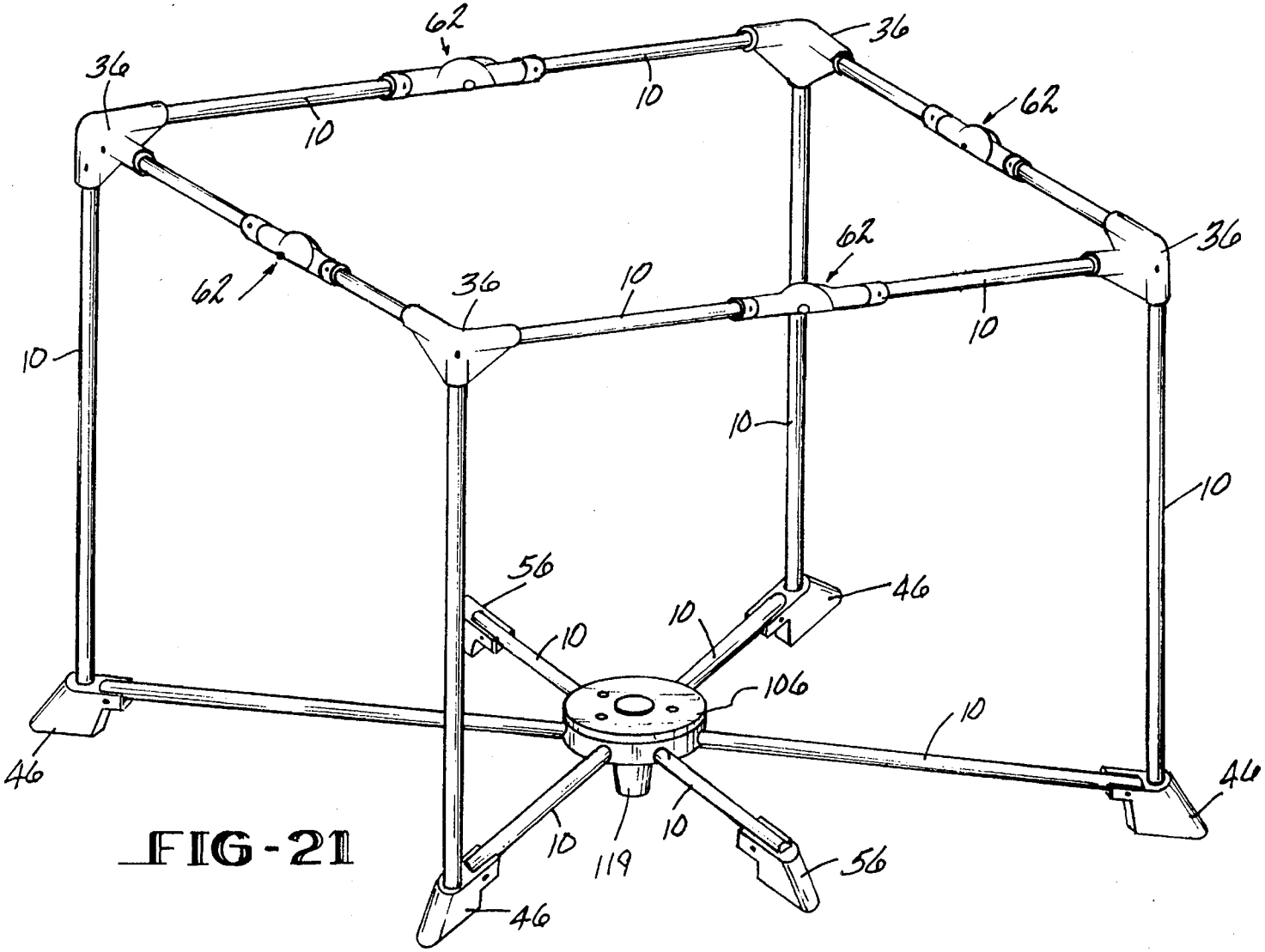
FIG. 21 is a perspective view of a preferred assembled frame for a crib or playpen of the present invention.

FIG. 21 shows a fully assembled crib or playpen frame of the present invention with all four aspects of the present invention. The frame is foldable by collapsing downward the upper rails comprised of tubing sections 10 and hinged collar assemblies 62 and simultaneously raising central hub assembly 106, thereby drawing together the four vertical corner legs.

The crib or playpen will have a conventional cloth construction or structure (not shown) attached around the upper railings and vertical corner tubings and having four side sections and a floor section upon which the base construction may be laid. The preferred material is nylon fabric. The floor section may be preferably attached to the central hub assembly or the bottom tubings or both. The base construction is preferably foldable into multiple sections and then removable from the frame. Accordingly, when the crib or playpen has to be folded and stored, one merely removes the base from the frame/cloth assembly and folds the base into a storable manner. Then, the four hinged collar assemblies are rotated to disengage the four upper railings and thereby fold them downward. Simultaneously, central hub assembly can be moved upward, thus pivoting the bottom tubings upward. These actions of folding downward the upper railings and moving the central hub assembly and bottom tubing upward causes the frame to collapse together into a folded and storable position. Because the parts of the frame and base construction are much lighter than other commercial cribs and playpens, the transportation of the playpens and cribs of the present invention is much easier.

The tubings 10 employed in the present invention may be also used in other child and infant products such as strollers, swing sets, carriages, baby carriers, high chairs, hook-on chairs, and the like.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A child enclosure structure comprising a base and a multiside enclosing frame wherein said frame comprises tubing sections made of lightweight, high modulus fiber-reinforced plastic matrix composite tubing having a weight of 0.25 pounds or less per lineal foot and wherein said plastic matrix is a thermoplastic resin or thermoset plastic resin with a minimum modulus of 250,000 psi; a minimum tensile strength of 6,000 psi; and a glass transition temperature of at least 50° C. and wherein said high modulus fiber reinforcement is selected from the group consisting of carbon fibers, aramid fibers, glass fibers, polyolefin fibers, boron fibers, and mixtures thereof.

2. The structure of claim 1 wherein said plastic matrix is an epoxy thermoset plastic.

3. The structure of claim 1 wherein said plastic matrix is a nylon thermoplastic resin with a minimum modulus of 325,000 psi and a minimum tensile strength of 10,000 and a thermoplastic resin $T_g$ of at least 75° C.

4. The structure of claim 1 wherein ratio of high modulus fibers to plastic matrix is from 70:30 to 30:70 by volume.

5. The structure of claim 1 wherein said composite tubing is constructed by filament winding.

6. The structure of claim 1 wherein said composite tubing is constructed by a pultrusion process.

7. The structure of claim 1 wherein the high modulus fiber reinforcement is carbon fibers.

8. A playpen made of the composite tubings of claim 1 and connective fittings, supports, and folding mechanisms consisting of molded plastics containing lightening fillers, whose density is no more than 0.9 grams per cubic centimeter.

9. A foldable child and infant enclosure frame comprising:

(a) a plurality of collapsible upper rails wherein each upper rail comprised of two tubing sections and a centrally located hinged collar assembly for releasably maintaining each said upper rail in a non-collapsed position; said hinged collar assembly comprising (i) two tubing extensions, each tubing extension protruding from one of said tubing extensions; (ii) a hinge; (iii) two collar halves attached together by said hinge and overlaying and rotatable around said two tubing extensions; (iv) a locking mechanism for holding said hinged collar assembly and tubing sections in a locked non-collapsible straight horizontal axis when said hinge and said collar halves are rotated around said tubing extensions to a first position; said locking mechanism releasable by rotating said hinge and said collar halves to a second position, thereby allowing said upper rail to be collapsible;

(b) a lower frame assembly;

(c) a plurality of vertical corner legs; each corner leg having an upper end and a lower end;

(d) a plurality of upper corner connections for interconnecting adjacent upper rails and said upper end of said corner legs together; and (e) a plurality of lower corner connections for interconnecting said lower ends of corner legs and lower frame assembly together and wherein said tubing sections are a lightweight, high modulus fiber-reinforced plastic matrix composite tubing having a weight of 0.25 pounds or less per lineal foot and wherein said plastic matrix is a thermoplastic resin or thermoset plastic resin with a minimum modulus of 250,000 psi; a minimum tensile strength of 6,000 psi; and a glass transition temperature of at least 50° C. and wherein said high modulus fiber reinforcement is selected from the group consisting of carbon fibers, aramid fibers, glass fibers, polyolefin fibers, boron fibers, and mixtures thereof.

10. A foldable child and infant enclosure frame comprising:

(a) a plurality of collapsible upper rails comprised of tubing sections;

(b) a plurality of vertical corner legs, each corner leg having an upper end and a lower end;

(c) a plurality of upper corner connections for interconnecting adjacent upper rails and said upper ends of corner legs together;

(d) a plurality of lower rails having inner ends and outer ends;

(e) a plurality of lower corner connections for interconnecting the lower ends of said corner legs to the outer ends of said lower rails; said lower rails capable of pivoting upwardly at said lower corner connections; and (f) a central hub assembly comprising (i) a central hub foot having a plurality of openings for said plurality of lower rails; (ii) a central hub top; and (iii) a ring positioned between said central hub foot and said central hub top; said inner ends of said lower rails interconnected to said ring and capable of being pivoted downwardly in said openings when said central hub assembly is raised.

11. The frame of claim 10 wherein said tubing sections are a lightweight, high modulus fiber-reinforced plastic matrix composite tubing having a weight of 0.25 pounds or less per lineal foot and wherein said plastic matrix is a thermoplastic resin or thermoset plastic resin with a minimum modulus of 250,000 psi; a minimum tensile strength of 6,000 psi; and a glass transition temperature of at least 50° C. and wherein said high modulus fiber reinforcement is selected from the group consisting of carbon fibers, aramid fibers, glass fibers, polyolefin fibers, boron fibers, and mixtures thereof.

12. A foldable child or infant enclosure frame comprising:

(a) a plurality of collapsible upper rails; each upper rail comprised of two tubing sections and a centrally located hinged collar assembly for releasably maintaining each said upper rail in a non-collapsed position; said hinged collar assembly comprising (i) two tubing extensions; each tubing extension protruding from one of said tubing extensions; (ii) a hinge; (iii) two collar halves attached together with said hinge and overlaying and rotatable about said two tubing extensions; (iv) a locking mechanism for holding said hinged collar assembly and tubing sections in a locked non-collapsible straight horizontal axis when said hinge and said collar halves are rotated around said tubing extensions to a first position; said locking mechanism releasable by rotating said hinge and said collar halves to a second position, thereby allowing said upper rail to be collapsible downward;

(b) a plurality of vertical corner legs, each corner leg having an upper end and a lower end;

(c) a plurality of upper corner connectors for interconnecting adjacent upper rails and said upper ends of corner legs together;

(d) a plurality of lower rails having inner ends and outer ends;

(e) a plurality of lower corner connections for interconnecting the lower ends of said corner legs to the outer ends of said lower rails; said lower rails capable of pivoting upwardly at said lower corner connections; and (f) a central hub assembly comprising (i) a central hub foot having a plurality of openings for said plurality of lower rails; (ii) a central hub top; and, (iii) a ring positioned between said central hub foot and said central hub top; said inner ends of said lower rails interconnected to said ring and capable of being pivoted downwardly in said openings when said central hub assembly is raised.

13. The frame of claim 12 wherein said tubing sections are a lightweight, high modulus fiber-reinforced plastic matrix composite tubing having a weight of 0.25 pounds or less per lineal foot and wherein said plastic matrix is a thermoplastic resin or thermoset plastic resin with a minimum modulus of 250,000 psi; a minimum tensile strength of 6,000 psi; and a glass transition temperature of at least 50° C. and wherein said high modulus fiber reinforcement is selected from the group consisting of carbon fibers, aramid fibers, glass fibers, polyolefin fibers, boron fibers, and mixtures thereof.

14. The frame of claim 13 wherein a securing device is attached to said frame, said securing device capable of attaching said frame to other object.

15. A child and infant enclosure structure comprising a frame of claim 13, a cloth construction fitted to said frame having a plurality of side sections and a floor section and a base construction laying upon said floor section.

16. The child and infant enclosure structure of claim 15 wherein base is a multilayer construction comprising the combination:

(a) a foam cushion mattress pad on top of;

(b) a high tensile strength film skin on top of;

(c) a core material on top of; and (d) a high tensile strength film skin.

* * * * *